United States Patent [19]

Zahradnik

[11] 4,406,358

[45] Sep. 27, 1983

[54] COIN PROTECTOR FOR COIN OPERATED WASHER DRYER

[76] Inventor: Miles D. Zahradnik, 420 E. Sixth St., Momence, Ill. 60954

[21] Appl. No.: 315,636

[22] Filed: Oct. 28, 1981

[51] Int. Cl.[3] ..... G07F 9/06; E05B 65/00

[52] U.S. Cl. ..... 194/1 A; 70/77; 70/159; 70/164; 232/15

[58] Field of Search ..... 194/1 A, 1 B, 92, 93; 232/15, 16; 109/58; 70/63, 77, 81, 158–164, 166–173, 416, 417

[56] References Cited

U.S. PATENT DOCUMENTS

| | | | |
|---|---|---|---|
| 1,955,462 | 4/1934 | Kaufman | 70/417 X |
| 2,755,748 | 7/1956 | Abell | 109/52 |
| 3,180,473 | 4/1965 | Garvey | 194/1 A |
| 3,391,256 | 7/1968 | Nawman | 179/189 |
| 3,665,736 | 5/1972 | Wilson | 70/78 |
| 3,833,104 | 9/1974 | Blum | 232/15 X |
| 4,031,722 | 6/1977 | Michelman et al. | 70/63 |
| 4,051,790 | 10/1977 | Meditz et al. | 109/58 |
| 4,135,375 | 1/1979 | Voegeli | 70/77 |
| 4,194,775 | 3/1980 | Shea | 292/307 |
| 4,350,032 | 9/1982 | Kochackis | 70/161 X |
| 4,370,873 | 2/1983 | Edmunds | 194/1 A X |

*Primary Examiner*—F. J. Bartuska

*Attorney, Agent, or Firm*—McCaleb, Lucas & Brugman

[57] ABSTRACT

A security guard for protecting the coin receptor unit of a coin operated automatic washing machine, dryer or similar machine embodying a heavy metal cage structure fitted about the coin rceptor housing so as to prevent unauthorized removal of the coin box therefrom. The guard is provided with a first sidewall member and a top wall member which are integrally related at right angles to one another. A second sidewall member is hingedly joined to the top wall member and operationally parallels the first sidewall member. A fixed bolt or shaft extends from the inside of the first sidewall member laterally through the coin receptor unit and is received through an opening in the second sidewall member when the latter is swung into operating position. A front wall member of the guard is also hinged to the first sidewall member and is arranged to swing over the front end of the receptor unit, blocking off access to the coin box. The front wall member is provided with an opening for the passage of a hardened steel shaft or bolt which anchors to the front wall member and passes through an opening formed for that purpose near the outer end of the fixed bolt so that the two are thus intersectingly interlocked exteriorly of the receptor and guard in operation. A suitable padlock or other locking means is provided to secure the bolt and shaft in their interlocked relationship, preventing its unauthorized removal.

3 Claims, 6 Drawing Figures

COIN PROTECTOR FOR COIN OPERATED WASHER DRYER

BACKGROUND OF THE INVENTION

Coin operated washers, dryers and similar machines are a familiar part of the American scene. Usually, such installations are found in laundry rooms of apartment dwellings, commercial "self service" laundry establishments, and the like. In most instances, the machines are equipped with a box-like coin receptor unit attached to the machine and characterized by a coin receiving means in which appropriate coins are deposited to initiate the machine's operating cycle. Typically, these receptor units include a coin box in which the deposited coins are collected. Such coin boxes, although locked, represent an attraction for thieves and vandals who break into the receptor unit and pilfer the coins, usually damaging the receptor unit in the process.

BRIEF DESCRIPTION OF THE INVENTION

This invention is directed to a security guard for the purpose of deterring or preventing unauthorized entry and tampering with such receptor units.

In brief, this invention contemplates a heavy metal guard cage that fits over the coin receptor unit mounted to the washer, dryer or similar machine. The metal cage is made of integrally related and right angularly disposed side and top wall members which fit over one side and the top of the receptor unit. Such sidewall member is provided with a fixed bolt or shaft extending outwardly therefrom and beneath the top wall for passage laterally through the receptor unit. A second sidewall member is hinged to the top wall member and swings over the outer end of the fixed bolt exteriorly of the receptor unit. A front wall member also is hinge-mounted to swing over the front end of the receptor unit, blocking off access to the coin box. The hinge-mounted front wall member carries a removable second bolt member which passes through an opening formed near the outer end of the fixed bolt whereby the two bolts may be intersectingly interlocked exteriorly of the second sidewall member. Suitable lock means, such as a key operated padlock, are employed to secure the two bolts in interlocked relationship thereby preventing unauthorized removal of the security device of this invention.

The principal object of this invention is to provide a security device for deterring or preventing entry into a coin box associated with an automatic coin operated machine, such as a washer or dryer.

Still another object of this invention is to provide a security device for coin operated washers and dryers which is simple to manufacture and install and is effective in its operation.

Having thus described this invention, the above and further objects, features and advantages thereof will be recognized by those familiar with the art from the following description of a preferred embodiment thereof, illustrated in the accompanying drawings, and representing the best mode presently contemplated so as to enable those of skill in the art to practice this invention.

IN THE DRAWINGS

DESCRIPTION OF THE PREFERRED EMBODIMENT

Figure 1:
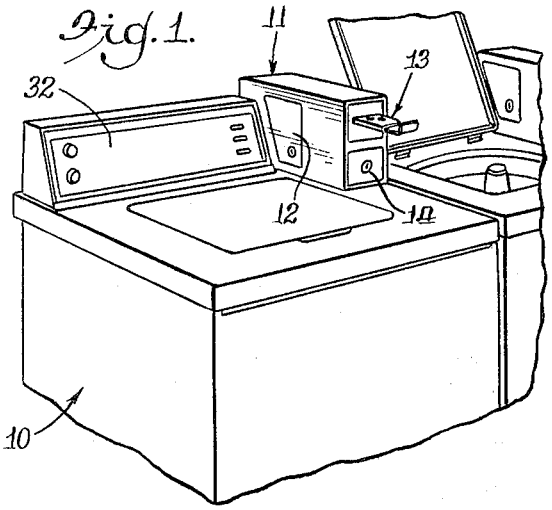
FIG. 1 is a partial perspective view showing a typical washing machine with coin receptor with which the present invention is useful.

Turning now to the specifics of the preferred embodiment of this invention illustrated in the drawings, initial reference is made to FIG. 1 illustrating a typical washing machine 10 equipped with a coin receptor unit 11 for controlling its operation in accordance with the deposit of a predetermined coin value, all in a known manner. As shown, the receptor unit 11 comprises essentially a rectangular-shaped cubical having a side access door 12 by which maintainence personnel can have access to the internal wiring and mechanisms associated therewith. Receptor 11 also has a coin receiving slide actuator 13 in which one or more coins are deposited and then placed in position for reception by the unit 11 by sliding the same inwardly until the coins are released to an appropriate counting mechanism for eventual deposit in a locked coin box 14. Although there are other coin receptor units to which the principles and concepts of this invention may apply with equal facility, that illustrated in FIG. 1 is typical of the commercially available units normally associated with washing machines, dryers and like equipment and has been selected herein as the best mode for illustrating the utility of the present invention.

Figure 2:
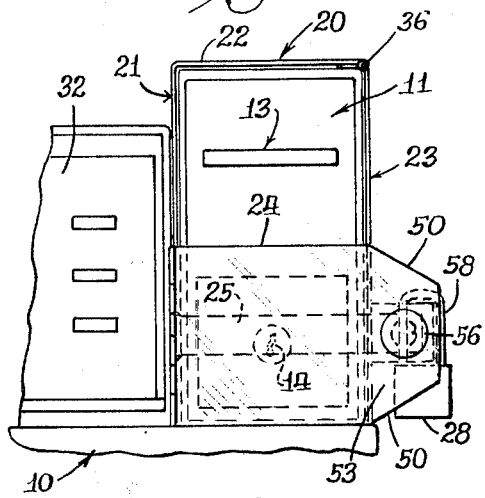
FIG. 2 is a front elevation with portions broken away illustrating the coin receptor seen in FIG. 1 with the security guard of this invention mounted thereover.
Figure 5:
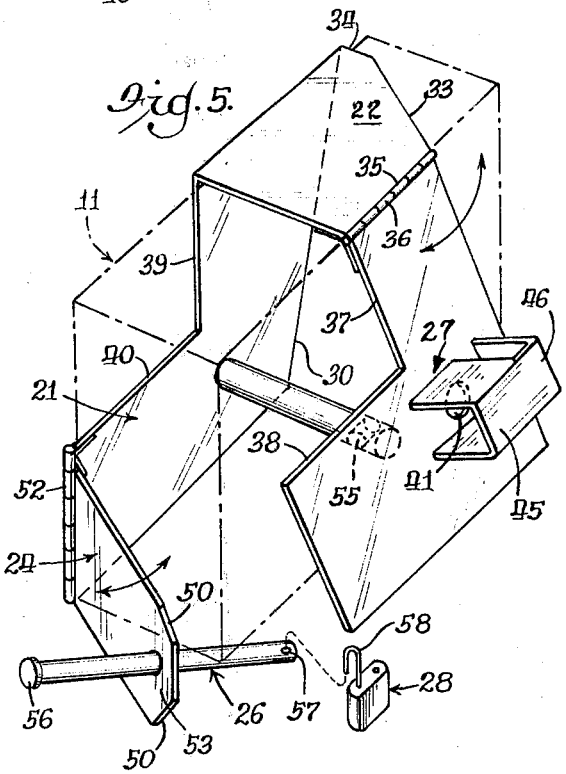
FIG. 5 is a perspective showing of the security guard according to this invention and indicating the mode of mounting the same on coin receptor.
Figure 6:
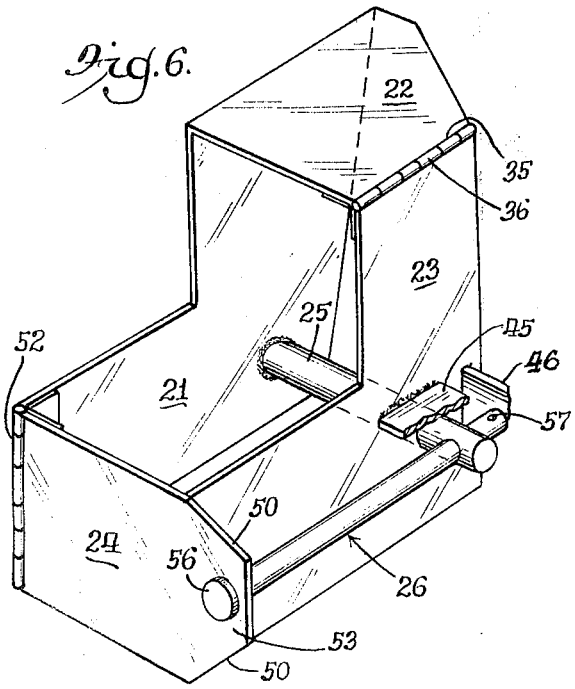
FIG. 6 is another perspective view of the security guard illustrated in FIG. 5 showing the position of parts thereof as they appear when mounted on the coin receptor.

With special reference now to FIGS. 2 through 6 of the drawings, the detailed aspects of the current invention will be set forth. As shown in such figures, the guard 20 according to this invention, comprises a first sidewall member 21 which is normally disposed in an operationally vertical position over an adjacent side of the receptor unit 11 (see FIG. 2). Wall 21 is integrally formed with a top wall 22 adapted to partially overcover the upper side or top of the receptor unit. A second sidewall 23 which parallels sidewall 21 extends from the top wall 22 in operation. A front wall 24 is also provided to extend between the two sidewalls 21 and 23 over the front end of the receptor so as to enclose the coin box 14. Wall 21 is fitted with a first fixed shaft or bolt member 25 which extends from the inside face thereof and between the two sidewalls 21 and 23 as best illustrated in FIGS. 2 and 6 of the drawings. The front wall 24 is also fitted with a second bolt member 26 mounted to extend rearwardly from wall 24 laterally outwardly of the sidewall 23 to intersect the first bolt member 25 with interlocking relationship as will be described in more detail hereinafter. Suitable guard means 27 are provided to overcover the projecting ends of the two bolt members 25 and 26 exteriorly of sidewall 23 and a padlock or other similar locking device 28 is employed to secure the two bolt members in operating relationship, as will be amplified presently.

The wall members 21 through 24 of the guard device, according to this invention, are all constructed of heavy-gauge rigid material such as steel, iron or the like. Typically, such wall members will bear a thickness of substantially ⅛ of an inch to insure against bending as by a pry bar or the like in the hands of a vandal or burglar. Shown best in FIG. 3, sidewall 21 is generally rectangular in shape except for its rear edge 30 which is cut at an angular slope generally paralleling the sloping disposition of the control panel 32 on a washing machine 10.

Formed at generally right angles to wall 21 (see FIGS. 5 and 6) is a top wall 22, distinguished by a generally rectangular plan profile except for the elimination or cutting away of one rear corner thereof to provide a sloping or angular disposed rear edge 33 thereon in angular intersecting relationship with a short rear edge 34 of the wall 22 and one side edge 35 thereof (FIG. 5). Edge 35 of the wall 22 is particularly distinguished by hinge 36 which interjoins the wall 22 with the second sidewall 23 whereby the latter is adapted for hinging movement about a generally operationally horizontal axis to swing vertically from between horizontal and vertical positions as indicated best in FIG. 5. The pintle of this hinge is unremovable, and the leaves thereof are appropriately welded to the inside faces of the two walls 22 and 23 to be secure from pry bars and the like.

Figure 3:
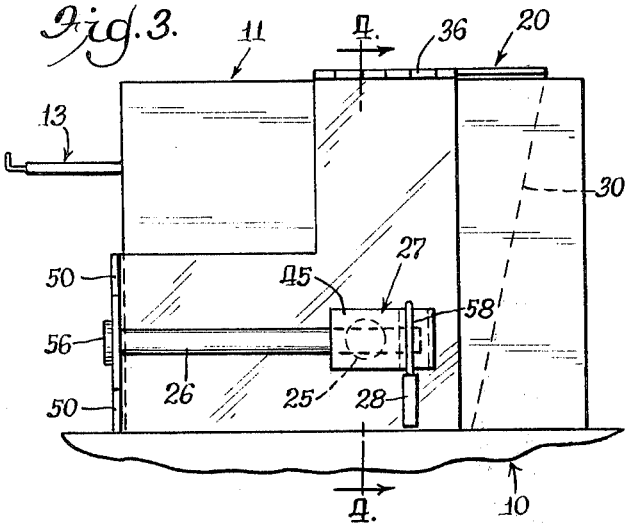
FIG. 3 is a side elevational view of the receptor and security guard combination shown in FIG. 2.

The second sidewall 23, as best illustrated in FIGS. 3, 5 and 6, is generally L-shaped in profile with edges 37, 38 thereof corresponding to and adapted for operational alignment with the edges 39 and 40 respectively of the first sidewall 21. In addition, to its cut-out configuration sidewall 23 also includes an opening 41 receptive of the outer end of the fixed bolt 25 in assembly about the coin receptor (FIG. 6).

Mounted over the opening 41 and outwardly of the outside face of wall 23 is the U-shaped guard member 27 having a first portion 45 which is welded to the wall 23 in position to protectively encase the outer end of the fixed bolt member 25 as it protrudes through wall 23 in operation. In addition to the U-shaped portion 45, the guard member 27 includes a secondary portion or extension 46 which protectively covers the outer end of the movable bolt member 26 when the latter is in its operating position with bolt 25. The guard means 27 so provided effectively deters tampering with the interlocked bolt means and the lock 28 in final assembly.

The front wall member 24 of the security guard, according to this invention, as shown best in FIGS. 5 and 6, is generally rectangular in formation except for angularly cut corners 50, 50 at the outer or free end thereof. It will be understood from FIGS. 5 and 6 that the opposite end of the wall member 24 is hingedly connected to the adjacent or outer end of the first sidewall member 21 by hinged means 52, in the same manner as employed in the interconnection of the top wall member 22 and sidewall member 23. Thus, the wall member 24 is adapted for arcuate swinging movement about the hinge means 52 which is disposed with a vertical axis to permit generally horizontal swinging movement of the front wall 24. As noted best in FIG. 2 for example, the wall member 24 is of a greater length or lateral dimension that the lateral spacing between sidewall members 21 and 23 so as to provide an extending tongue portion, designated 53, which projects past the second sidewall member 23 in the operational positioning of the guard device 20. The tongue portion 53 is distinguished by a generally centrally located opening (un-numbered) receptive of the movable bolt member 26 in assembly; disposing the axis of such bolt member outwardly or beyond the second sidewall member 23 in operation.

Turning now to the features of the stationary bolt member 25, as previously mentioned the same is fixed at one end, as by welding or the like, to the inside face of the first sidewall 21 so as to protrude at right angles to the plane of such wall and to one side thereof to extend generally across the interior of the cage-like structure presented by the guard device of this invention. Typically, the bolt member 25 is of case-hardened steel and is substantially one inch in diameter. Adjacent the outer end of the bolt member 25 (FIG. 5) is a crossbore 55, the axis of which is disposed for coincidental alignment with the axis of the movable bolt member 26 in assembly with the bolt member 25. Thus, when the second sidewall is in an upright position in the manner illustrated in FIG. 6, for example, the opening of the bore 55 is disposed outwardly of the wall member 23 and in alignment for coaxial reception of the movable bolt member 26.

Turning now to the features of the movable bolt member 26, it is to be noted that the same is of a diameter somewhat smaller than the stationary or fixed bolt member 25. It is preferably made of case-hardened steel, and has an enlarged head portion 56 at the outer end thereof which fits in a recess or counterbore (un-numbered) formed in the outer face of the front wall member 24. Thus, when the bolt member 26 is disposed in its operating position, as shown in FIG. 6, the head portion 56 thereof lies nearly flush with the plane or outer face of the wall member 24. Near the opposite end of bolt member 26 from its head portion 56 is an opening 57 which is of a diameter to accomodate the reception of the locking hasp 58 of the lock means 28. (See FIG. 3).

Figure 4:
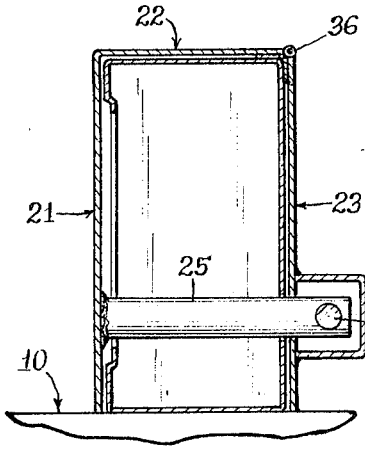
FIG. 4 is a cross-sectional view taken substantially along vantage line 4—4 of FIG. 3 and looking in the direction of the arrows thereon.

Having described the various elemental portions of the improved safety guard device of this invention, its use and operation will now be set forth. In this regard, reference is specifically made to FIG. 5 of the drawings which illustrates in general the mounted condition of the device 20 over and about the receptor unit 11. Specifically, it will be noted and understood that the fixed bolt member 25 extends laterally through the receptor unit. To accomplish this, the access door 12 (see FIG. 1) is removed and the stationary bolt member 25 is inserted therethrough. A suitable opening is punched or cut out of the opposing wall of the receptor unit for passage of the bolt member 25 as illustrated in FIG. 2. Once the bolt member is inserted through the receptor unit disposing the first sidewall member 21 in adjacent parallelism with the corresponding sidewall of the receptor unit, it will be noted that the top wall member 22 thereof extends partially over the top wall of the receptor unit as shown in FIGS. 3 and 5. The second sidewall member 23 is then swung downwardly from an elevated position as indicated in FIG. 5 with opening 41 therein passing over the outer end of the fixed bolt member 25 to permit wall 23 to assume its operationally vertical condition in adjacent parallelism with the corresponding sidewall of the receptor unit, as illustrated in FIGS. 2, 4 and 6. It will be noted from FIG. 4 in particular that when wall 23 is disposed in its operating position, the guard member 27 overcovers the outer end of the bolt 25. Once the unit 20 is in place, as above described, the front end wall 24 thereof is swung about its hinged axis so as to overcover the coin box 14 of the receptor unit, disposing wall 24 in normal or right angular relationship with the two sidewall members 21 and 23 as shown in FIG. 6. In this position, the movable bolt member 26 is inserted through the opening in the tab portion 53 of the wall 24, so as to insert the movable bolt member through the opening 55 adjacent the outer end of the fixed bolt member 25. Once the two bolts are in such interlocking relationship, the hasp portion 58 of the lock means 28 is inserted through opening 57 near the outer end of the movable bolt member, securing the two bolts in their interlocked relationship and preventing unauthorized removal of the guard unit 20 from the receptor unit when the lock means 28 is in locked condition. In this latter regard, it will be noted that the guard portion 46 extends around the outer end of the movable bolt member 26 partially enclosing the same, with the hasp portion 58 of the lock means passing around the guard portion 46 in its engaged condition with the movable bolt member 26. Once so secured together, removal of the guard unit for access to the opening formally covered by the access door 12 and for removal of the coin box 14 is accomplished only by authorized removal of the lock means 28, withdrawal of the bolt means 26 and removal of the various wall members 21–24 from their protective relationship about the receptor unit.

From the foregoing description, it is believed that those who are familiar with the art will readily understand and appreciate its novel advancement over prior devices of this general character and will recognize that while the same has been disclosed and described in association with a preferred embodiment thereof illustrated in the accompanying drawings, the same is nevertheless susceptible to variation, modification and substitution of equivalents without departing from the spirit and scope of this invention as defined in the following appended claims.

The embodiments of the invention in which an exclusive property or privilege is claimed are defined as follows:

1. A security guard for an automatic coin operated washing machine or dryer having a coin receptor unit, comprising: a first sidewall member and a top wall member integrally formed to fit over one side and the top of the coin receptor unit; a second sidewall member operationally positioned parallel to the first sidewall member in its mounted position over the receptor unit and having hinged connection with the top wall member; a front wall member having hinged connection with said first sidewall member and presenting a free end portion extending past the second sidewall member when in operating position; a first bolt means fixed at one end to the first sidewall member and operationally positioned laterally through the receptor unit and an opening formed in the second sidewall member to protrude therebeyond; said first bolt means having an opening therethrough near its outer end; and a second bolt means removably mountable through an opening in the said front wall member so as to parallel said second sidewall member in its operating position and adapted to extend through said opening in said first bolt means; whereby said two bolt means are intersectingly interlocked exteriorly of the second sidewall member, and locking means engageable with said second bolt means for securing the two bolt means in interlocked relation whereby to prevent unauthorized removal of the guard from the receptor unit.

2. The combination of claim 1 wherein said front wall member barricades a coin box of the receptor unit and is movable to provide access to said coin box by disengagement of said bolt and locking means.

3. The combination of claim 1 and guard means on said second sidewall member, overcovering the junction of intersection of said two bolt means.

* * * * *